US005282760A

United States Patent [19]

Aimasso

[11] Patent Number: 5,282,760

[45] Date of Patent: Feb. 1, 1994

[54] ELECTRIC CONNECTOR

[75] Inventor: Mario Aimasso, Rivoli, Italy

[73] Assignee: Framatome Connectors Italia S.P.A., Turin, Italy

[21] Appl. No.: 873,293

[22] Filed: Apr. 23, 1992

[30] Foreign Application Priority Data

Apr. 24, 1991 [IT] Italy ..... TO91 U 000096

[51] Int. Cl.[5] ..... H01R 13/436

[52] U.S. Cl. ..... 439/752; 439/466

[58] Field of Search ..... 439/466, 473, 752

[56] References Cited

U.S. PATENT DOCUMENTS

| | | | |
|---|---|---|---|
| 4,082,400 | 4/1978 | Gansert | 439/341 |
| 4,200,350 | 4/1980 | Zimmerman, Jr. | 439/752 |
| 4,867,705 | 9/1989 | Yuasa | 439/595 |
| 5,067,913 | 11/1991 | Sagawa | 439/752 |

FOREIGN PATENT DOCUMENTS

| | | | |
|---|---|---|---|
| 0003649 | 8/1979 | European Pat. Off. . | |
| 0276895 | 8/1988 | European Pat. Off. . | |
| 2354795 | 5/1975 | Fed. Rep. of Germany . | |
| 2849077 | 5/1980 | Fed. Rep. of Germany . | |
| 2071926 | 9/1981 | United Kingdom | 439/752 |
| 9006603 | 6/1990 | World Int. Prop. O. . | |

*Primary Examiner*—Gary F. Paumen

*Attorney, Agent, or Firm*—Sandler, Greenblum & Bernstein

[57] ABSTRACT

An electric connector comprising an outer casing; a terminal block housed inside the casing and having a number of through cavities arranged in two parallel rows adjacent to the lateral walls of the terminal block; and a number of electric terminals housed inside respective cavities and retained therein by respective primary connecting means and by secondary retaining means consisting of a pair of comb elements having teeth cooperating with respective terminals; the comb elements being integral with the terminal block and connected to it by an elastic hinge.

4 Claims, 2 Drawing Sheets

ELECTRIC CONNECTOR

BACKGROUND OF THE INVENTION

The present invention relates to an electric connector, particularly for connecting an electronic control system to the electric system of a motor vehicle.

Known connectors of the aforementioned type substantially comprise a terminal block made of insulating material and having a number of cavities, each housing a terminal; and an outer casing housing the terminal block and having retaining means for fitting to the vehicle.

Connectors of this type as known, for example, from DE-C3-2 354 795, EP-B1-0 003 649, DE-A1-2 849 077, and WO-A1-90/06603.

The cavities on the terminal block are typically arranged in two side by side rows, and means are provided for retaining the terminals inside the cavities.

In the embodiment known from DE-C3-2 354 795 (and corresponding U.S. Pat. No. 4,082,400), the retaining means consist of a pair of comb elements mounted on opposite sides of the body and held in place by the casing. The comb elements present a number of teeth engaging through seats formed in the body and corresponding with the cavities. The teeth therefore penetrate partially inside the cavities, and cooperate with respective mating portions of the terminals.

Known connectors of the type briefly described above present a major drawback.

Should one of the comb elements fail to be inserted at the assembly stage, this does not prevent insertion of the terminal block inside the casing, and the absence of the comb element goes undetected, especially if assembly is performed automatically. The terminals are therefore not retained inside the cavities any more, so that, when connected to the complementary connector, the insertion load on the terminals may result in withdrawal from the cavities.

SUMMARY OF THE INVENTION

It is an object of the present invention to provide a connector of the aforementioned type, designed to overcome the aforementioned drawbacks typically associated with known types.

According to the present invention, there is provided an electric connector comprising:

an outer casing a terminal block housed inside said casing and having a number of through cavities arranged in at least one row parallel and adjacent to a lateral wall of said terminal block;

a number of electric terminals housed inside respective said cavities and retained therein by respective primary connecting means; and secondary means for retaining said terminals inside said cavities;

said secondary terminal retaining means comprising at least one comb element mounted through an opening in said lateral wall of said terminal block, and having a number of teeth cooperating with respective said terminals;

characterized by the fact that said comb element is integral with said terminal block and connected to the same by an elastic hinge.

BRIEF DESCRIPTION OF THE DRAWINGS

A preferred non-limiting embodiment of the present invention will be described by way of example with reference to the accompanying drawings, in which.

DETAILED DESCRIPTION OF THE INVENTION

Figure 1:
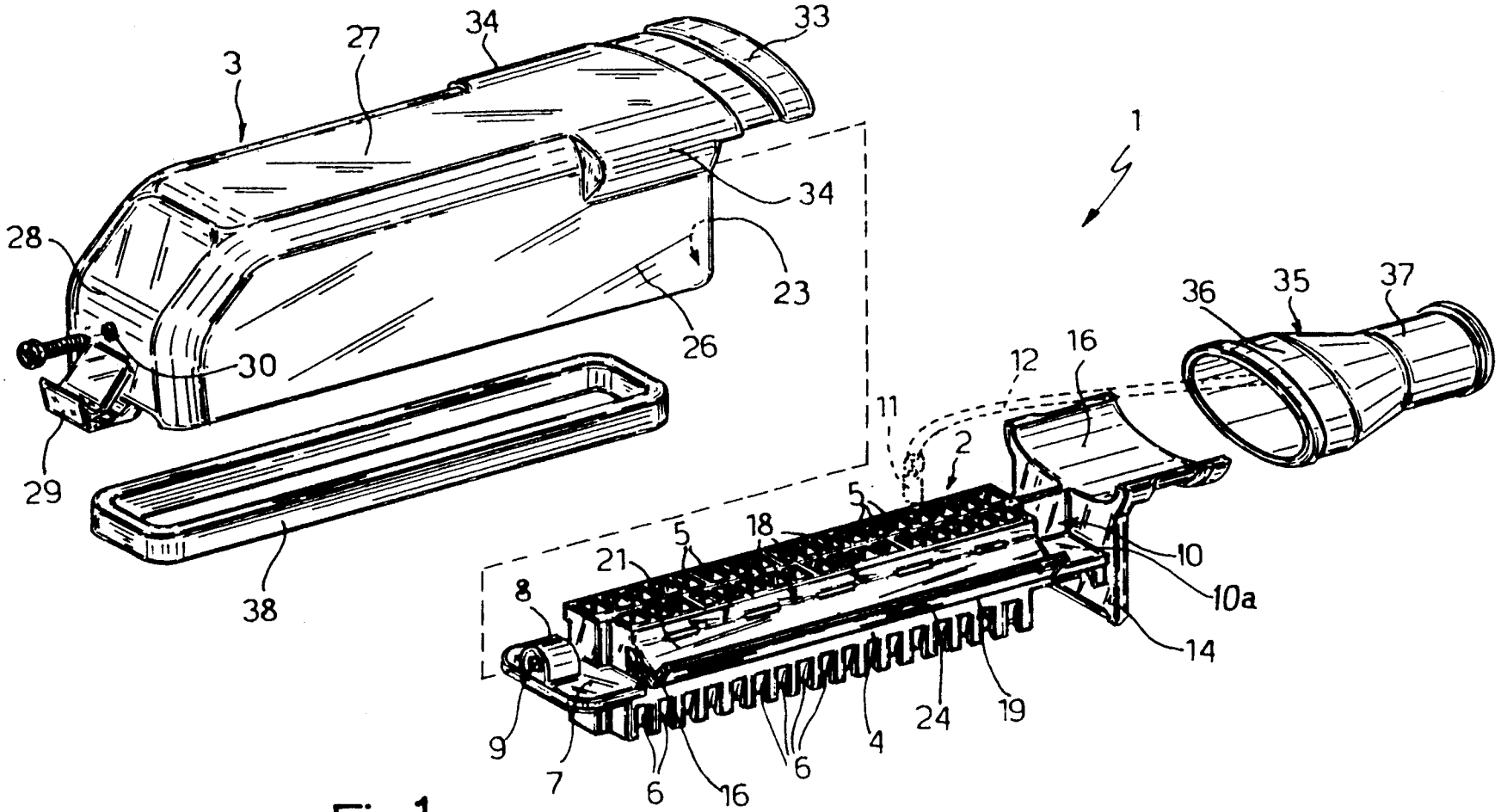
FIG. 1 shows an exploded view in perspective of a connector in accordance with the teachings of the present invention.
Figure 2:
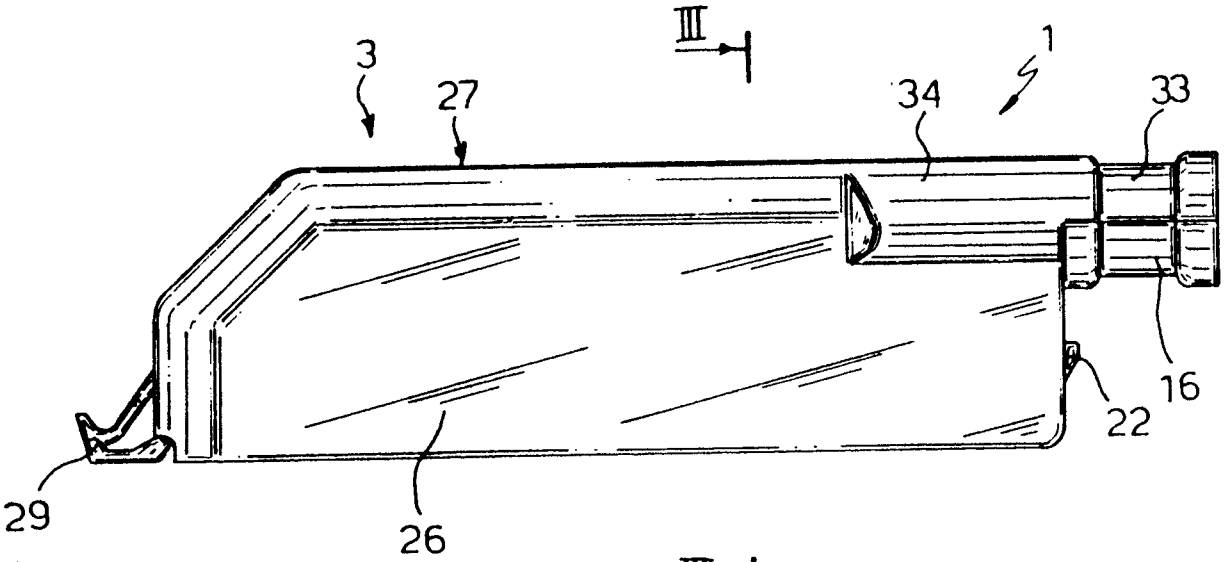
FIG. 2 shows a side view of the FIG. 1 connector.

Number 1 in FIG. 1 indicates a connector having a large number of ways and particularly designed for connecting an electronic control system to the electric system of a motor vehicle.

Connector 1 substantially consists of a terminal block 2 and an outer casing 3 housing block 2.

Terminal block 2 is substantially in the form of an elongated parallelepipedon, and is defined by a pair of lateral walls 4. Block 2 defines a number of through cavities 5 arranged in two rows parallel and adjacent to lateral walls 4, and extending parallel to the shorter side of walls 4. Lateral walls 4 define a number of elastic teeth 6 extending inside respective cavities 5 and constituting primary connecting means for respective known electric terminals 11, one of which is shown schematically by the dotted line in FIGS. 1 and 3.

From one axial end of terminal block 2, there extends longitudinally a plate 7 perpendicular to cavities 5 and having a projection 8 at one end, with an axial hole 9 for assembly to casing 3 as described later on.

From the opposite end of terminal block 2, there extends a rib 10 having a section substantially in the form of an upside down T with two flat lateral wings 10*a*, and a transverse wall 14 at one end for closing casing 3. From the side of wall 14 facing cables 12 connected to terminals 11, there projects a half shell 16 having a semi-elliptical section and the function of which will be explained later on. Transverse wall 14 also presents an outer tooth 22 for clicking connector 1 to a terminal board.

According to the present invention, each lateral wall 4 of terminal block 2 present a through opening 16 in the form of a longitudinally elongated rectangle and communicating with all the cavities 5 adjacent to wall 4. By means of a number of thin portions defining an elastic hinge 18, a longer side of opening 16 is fitted integral with a comb element 19 having a substantially L-shaped cross section Each comb element 19 comprises a number of teeth 20 (FIG. 3) penetrating inside respective cavities 5 and cooperating with a mating portion of terminals 11 for preventing withdrawal of the same as described later on. In more detail, each comb element 19 comprises a wall 1, a longitudinal side of which is connected to the side of opening 16 by means of elastic hinge 18; and a wall 24 extending perpendicularly from the opposite side of wall 21 and outwards of block 2. Teeth 20 extend parallel to wall 24, from the joining edge of walls 21 and 24.

In FIG. 1, terminal block 2 is shown in the molding position, wherein walls 21 of comb elements 19 slope substantially 45° outwards of block 2. As walls 21 are he same shape as respective openings 16, elements 19 may be turned about elastic hinges 18, so that walls 21 close openings 16, and walls 24 extend laterally, perpendicular to walls 4 and coplanar with plate 7 and lateral wings 10*a* of T-section rib 10. In this position (FIG. 3), teeth 20 of comb elements 19 penetrate inside respective cavities 5, cooperate with respective mating portions of terminals 11 for preventing axial withdrawal of the same from cavities 5.

Outer casing 3 of the connector is elongated in shape, with a substantially U-shaped cross section, and is defined laterally by a pair of parallel, substantially fl at walls 26, by a top wall 27, and by an end wall 28 having a hook-shaped elastic outer element 29 for connection to the terminal board End wall 28 also presents a through hole 30 for securing terminal block 2 inside casing 3 by means of a screw 31. On the end opposite end wall 28, casing 3 presents an opening 23 for longitudinally inserting terminal block 2, and, on the side opposite top wall 27, is open for connecting terminals 11 to the terminal board of the electronic control system.

The inside surfaces of lateral walls 26 present respective grooves 32 communicating with end opening 23 of casing 3, and designed to receive the lateral edges of plate 7, walls 24 of elements 19 and lateral wings 10*a* of rib 10.

In the opposite direction to end wall 28, top wall 27 extends in the form of a half shell 33 similar and complementary to half shell 16 of terminal block 2. In use, half shells 16 and 33 define a sleeve for the passage of cables 12.

Close to half shell 33, top wall 27 defines a pair of projections 34 by which to manually grip connector 1. Connector 1 also comprises a substantially funnel-shaped, elliptical-section sleeve 35 for protecting cables 12 and comprising a first portion 36 fitted over half shells 33 and 16, and a second smaller-section portion 37 cooperating elastically with cables 12.

Finally, connector 1 comprises a substantially rectangular peripheral seal 38 fitted about terminal block 2, between this and the inner walls of casing 3, and axially contacting plate 7, walls 24 and lateral wings 10*a* of rib 10.

Connector 1 is assembled as follows.

Figure 3:
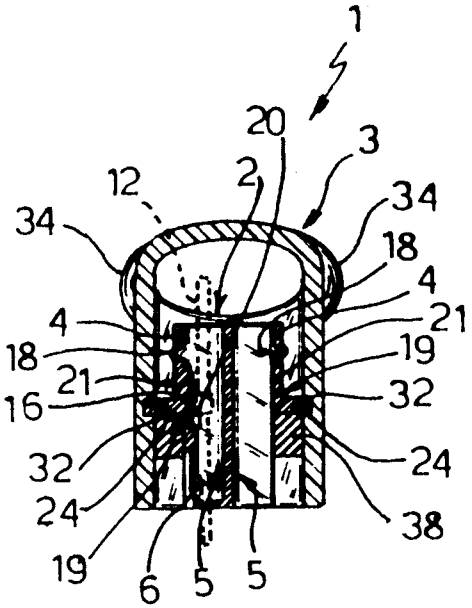
FIG. 3 shows a section along line III—III in FIG. 2.

Terminal block 2, complete with terminals 11, is inserted longitudinally inside casing 3, which is only possible by first turning both comb elements 19, from the molding position in FIG. 1, inwards of terminal block 2, as shown in FIG. 3. In this position, as already stated, terminals 11 are locked inside respective cavities 5; and plate 7, walls 24 of elements 19 and lateral wings 10*a* of rib 10 are coplanar and thus insertable inside grooves 32 in lateral walls 26 of casing 3.

Terminal block 2 is inserted longitudinally inside casing 3 until plate 7 cooperates with end wall 28 of casing 3, and transverse wall 14 of block 2 closes the end opening of casing 3 by fitting between and flush with lateral walls 26. Terminal block 2 is locked axially inside casing 3 by means of screw 31.

The connector is connected to the terminal board of the electronic control system in known manner, which is therefore not described in detail. Suffice it to say that connection is made by connecting tooth 22 and elastic elements 29 to respective mating elements on the terminal board; terminals 11 cooperate with respective electric terminals on the terminal board, and seal 38 is compressed between plate 7, walls 24 and rib 10, on the one hand, and a rectangular, peripheral contact surface on the terminal board, on the other, thus providing for effective sealing.

The advantages of the connector according to the present invention will be clear from the foregoing description. In particular, it provides for foolproof assembly of the secondary terminal retaining means (comb elements 19), which, unless correctly assembled, prevent assembly of the connector and insertion of block 2 inside casing 3, by cooperating with lateral walls 26.

Also, the fact that, once the connector as assembled, wall 14 is fitted between walls 26, flush with as opposed to frontally contacting the edge of the same, provides for particularly effective sealing when the connector is mounted vertically on the vehicle, with the cables downwards. In this case, any condensate runs off downwards along walls 26, instead of penetrating between walls 26 and wall 14.

To those skilled in the art it will be clear that changes may he made to connector 1 as described and illustrated herein without, however, departing from the scope of the present invention. For example, terminals 11 may be of any type, and, consequently, primary connecting teeth 6 and comb elements 19 of any shape.

I claim:

1. An electronic connector comprising:

an outer casing;

a terminal block housed inside said casing and having a number of through cavities arranged in at least one row parallel and adjacent to a lateral wall of said terminal block;

a number of electric terminals housed inside respective said cavities;

first retaining means for blocking said terminals inside said cavities;

second retaining means for preventing withdrawal of said terminals from said cavities, said second retaining means comprising at least one comb element integral with said lateral wall of said terminal block and connected thereto by an elastic hinge, said comb element comprising a plurality of teeth cooperable with mating portions of said terminals, a first wall hinged integrally along one side of said terminal block, and a second wall extending perpendicularly from the opposite side of said first wall and outward of said terminal block, wherein said first wall presents said teeth and engages said openings in said lateral wall;

wherein said comb element is movable between a molding position in which said terminals can be inserted into said cavities, and a terminal retaining position in which said teeth penetrate inside respective cavities, through openings of said lateral wall, to cooperate with said respective terminals locked by said first retaining means, so that said comb element allows assembly of said terminal block inside said outer casing only in said terminal retaining position.

2. A connector as claimed in claim 1, wherein said terminal block further comprises:

two parallel, side by side rows of cavities adjacent to respective lateral walls of said terminal block, and a pair of said comb elements hinged, respectively, to said lateral walls.

3. A connector as claimed in claim 2, wherein said casing further comprises a pair of inner lateral guides slidably engaged by said second walls of said comb elements.

4. A connector as claimed in claim 1, wherein said outer casing further comprises an end opening for insertion of said terminal block, and said terminal block comprises a wall for closing said end opening; wherein said wall fits between and substantially flush with the lateral walls of said outer casing.

* * * * *